United States Patent [19]

Walls

[11] Patent Number: 4,502,925

[45] Date of Patent: Mar. 5, 1985

[54] PROCESS FOR ALUMINUM SURFACE PREPARATION

[75] Inventor: John E. Walls, Hampton, N.J.

[73] Assignee: American Hoechst Corporation, Somerville, N.J.

[21] Appl. No.: 619,105

[22] Filed: Jun. 11, 1984

[51] Int. Cl.[3] ..... C25F 3/04; C25D 11/16; C25D 11/18

[52] U.S. Cl. ..... 204/33; 204/38.3; 204/38.7; 204/129.4; 204/129.75; 101/456; 101/459

[58] Field of Search ..... 204/17, 33, 38 A, 38 E, 204/129.35, 129.75, 129.4; 101/456, 459

[56] References Cited

U.S. PATENT DOCUMENTS

| | | | |
|---|---|---|---|
| 4,229,266 | 10/1980 | Usbeck | 204/38.3 |
| 4,242,417 | 12/1980 | Huang . | |
| 4,331,479 | 5/1982 | Toyama | 204/38.3 |
| 4,336,113 | 6/1982 | Walls et al. . | |
| 4,374,710 | 2/1983 | Walls . | |
| 4,396,468 | 8/1983 | Walls . | |

*Primary Examiner*—R. L. Andrews

*Attorney, Agent, or Firm*—Richard S. Roberts

[57] ABSTRACT

A method for treating an aluminum sheet useful for lithography by etching said sheet in an aqueous bath containing up to about 25% of nitric and/or hydrochloric acids and from about 1% to about 25% of an inorganic fluorine containing acid or salt thereof. Said etching step is sequentially followed by electrochemical graining and anodizing process steps.

21 Claims, No Drawings

PROCESS FOR ALUMINUM SURFACE PREPARATION

BACKGROUND OF THE INVENTION

The present invention relates to the preparation of aluminum sheet surfaces to provide the sheet with a surface suitable for use as part of a lithographic printing plate.

It has long been known to be advantageous to form a printing plate by coating a lithographically suitable photosensitive composition onto the surface of an aluminum sheet substrate with subsequent exposure to light through a mask with eventual development. The oleophilic image areas which remain accept and transfer ink during the printing process and the hydrophilic non-image areas accept water or aqueous solutions during printing to repel such greasy inks.

It has long been known that if the surface of the aluminum substrate were grained, either mechanically, for example by use of wire brushes or particulate slurries, or electrochemically by use of electrolytic solutions of acids such as nitric acid, the printing life of a plate may be substantially extended.

Electrolytic graining of aluminum and the electrolytic process has many advantages over mechanical graining. (See, for example, U.S. Pat. Nos. 3,072,546 and 3,073,765). For certain applications, a very fine and even grain is desired. When the aluminum is to be used as a support for lithographic printing plates such characteristics are especially advantageous. A fine and even grain can be obtained in an electrolyte consisting of an aqueous solution of hydrochloric acid, but the current density employed must be kept quite low or pitting of the aluminum surface will take place and, as a result of the low current density, a relatively long period is required to complete the graining. Electrolytic graining of aluminum sheets with hydrochloric or nitric acids is well known in the art as shown by U.S. Pat. Nos. 3,980,539; 3,072,546; 3,073,765; 3,085,950; 3,935,080; 3,963,594 and 4,052,275, among others.

In electrochemical graining, the surface area is greatly expanded thus providing superior lithographic characteristics. However, there is a problem associated with said systems. The surface, although uniform and having a large surface area, is relatively flat. This creates two problems: (1) Poor draw-down of a printing plate in a vacuum frame which results in halation, and (2) poor water carrying capabilities thereby resulting in difficulties in maintaining a wide latitude for the ink-water balance when printing. Both can have disadvantageous consequences in quality printing.

U.S. Pat. No. 4,242,417 teaches a method of graining the surface of an aluminum sheet substrate which comprises first subjecting the substrate to a mechanical graining treatment such as using a wire brush or wet slurry and then etching in a saturated aqueous solution of an aluminum salt of a mineral acid to which optionally up to 10 percent of a mineral acid may be added. Optionally, the graining action of this solution may be aided by electrolysis.

There are some drawbacks to this process. First, due to the slurry graining, the surface is directional in nature which affects printing quality and ink-water balance. Second, the surface is contaminated with microscopic particles used as the abrasive. Third, the process of slurry graining is one of perpetual change. As the brushes are used they become shorter. As the slurry is used it loses abrasivity, thus requiring additions of fresh material. The aluminum surface purity is a function of time due to a continual build-up of $Al(OH)_3$, $Al_2O_3$, and particulate aluminum. All this results in a surface fluctuating in quality.

The present invention seeks to retain the beneficial characteristics of electrochemical graining without suffering the detriments of mechanical graining. The surface prepared by the process of the present invention is matted by a chemical etching step and substantially eliminates the directionality in surface etching which is quite evident with mechanical graining. An electrochemical graining step follows the chemical etch to provide a superimposed grain on the etched surface. The result is a surface having an increased surface area with improved capillary wettability which manifests itself in an improved ink-water balance in printing plates produced with this substrate.

SUMMARY OF THE INVENTION

The invention provides an aluminum sheet substrate which has been produced by the method which comprises:

(a) immersing said sheet in an aqueous bath containing
  (i) up to about 25% by weight of hydrochloric and/or nitric acids, and
  (ii) from about 1 to about 25% by weight of an inorganic fluorine containing acid or a salt thereof;
  said immersion being conducted for a length of time sufficient to impart an etch to the surface of said aluminum sheet; and (b) electrochemically graining said sheet in an aqueous electrolyte comprising one or more acids selected from the group consisting of nitric acid and hydrochloric acid; and (c) anodizing said sheet in an aqueous electrolyte comprising one or more acids selected from the group consisting of sulfuric acid and phosphoric acid.

DETAILED DESCRIPTION OF THE PREFERRED EMBODIMENT

The aluminum sheets which may be employed in the practice of this invention, include those which are made from aluminum alloys which contain substantial amounts of impurities, including such alloys as Aluminum Association alloys 1050, 1100 and 3003. The thickness of the aluminum sheets which may be employed in the practice of this invention may be such as are usually and well known to be employable for such purposes, for example those which are from 0.004 inches to 0.025 inches in thickness; however, the exact choice of aluminum sheet may be left to the discretion of the skilled worker.

In the practice of the instant invention an aluminum sheet or web is first degreased, and then chemically etched by immersing the sheet into an aqueous bath containing (i) hydrochloric and/or nitric acid; and (ii) an inorganic fluorine containing acid or salt thereof which is preferably HF, $HSiF_6$, $HPF_6$, $HBF_4$, $K_2ZrF_6$, $K_2TiF_6$, $NH_4F$ or $NH_4HF_2$.

The hydrochloric and/or nitric acid is present in an amount of up to about 25% by weight of the bath composition, more preferably from about 5% to about 18% and most preferably from about 7% to about 12%.

The fluorine compound is present in the bath composition in an amount from about 1% to about 25% by weight, preferably from about 3% to about 15% and more preferably from about 5% to about 12% by weight. The aforesaid bath may optionally additionally contain other ingredients to enhance the surface characteristics of said sheet. Such ingredients include ammonium, potassium, sodium or lithium, persulfate, peroxydisulfate or disulfate. The bath may also contain sulfonic acids. The bath is preferably maintained at a temperature of from about 10° C. to about 95° C., more preferably from about 20° C. to about 80° C. and most preferably from about 25° C. to about 60° C. The immersion is preferably conducted for a time ranging from about 5 seconds to about 3 minutes. Longer times can be used but are not practical since excess aluminum continues to dissolve. A more preferable immersion time ranges from about 20–120 seconds and most preferably from about 40 to about 80 seconds. The aforesaid immersion process can be converted into an electrolysis process by optionally applying a current between the aluminum sheet and another electrode in the bath, but this is a costly option. If it is chosen either AC, or DC where the aluminum sheet is the cathode may be employed for about 30–60 seconds at about 30–45 Amps/dm$^2$.

The consistency of the etch is maintained since as the aluminum is etched, a water insoluble aluminum fluoride salt is produced which may simply be filtered off continuously. After the etch, the sheet is preferably rinsed and the electrochemical graining step is performed.

The next process step of this invention comprises electrolytically graining the aluminum in an aqueous electrolytic solution containing nitric acid and/or hydrochloric acid and may contain hydrogen peroxide. The optimum concentrations of the hydrochloric acid, nitric acid and hydrogen peroxide will depend upon such factors as the current density employed, the temperature of the electrolyte solution, and the properties of the aluminum article being grained. The optimum parameters can be readily determined by a few simple experiments.

Optionally the electrolytic solution may also contain oxalic acid, aluminum nitrate, aluminum chloride, or hydrogen peroxide, as described in U.S. Pat. No. 4,336,113; boric acid as described in U.S. Pat. No. 4,374,710 or any of a plethora of other additives known in the art of electrochemical graining.

The preferred concentration of nitric acid in the electrochemical graining step, ranges from about 3 g/l to about 20 g/l; more preferably 8 g/l to about 20 g/l; most preferably 10 g/l to about 15 g/l. Above about 20 grams per liter, no significant etching difference is noted until about 500 g/l is reached, at which point etching power begins to decrease. The preferred concentration of hydrochloric acid in the electrochemical graining step, ranges from about 3 g/l to about 100 g/l; more preferably about 5 g/l to about 60 g/l; most preferably about 8 g/l to 15 g/l. The preferred concentration of oxalic acid when it is used, ranges from about 1 gram per liter to about 80 grams per liter, more preferably about 5 to 45 grams per liter, most preferably about 8 to 20 grams per liter.

The preferred concentration of hydrogen peroxide, when it is used, ranges from about 1 g/l to about 60 g/l; more preferably about 10 to about 30 g/l; most preferably about 15 to 20 g/l.

The preferred concentration of aluminum nitrate when it is used is at about its saturation point, more preferably at about 65 to 70 grams per liter; most preferably 65 grams per liter.

The preferred concentration of aluminum chloride when it is used ranges from about 1 g/l to about 10 g/l; more preferably about 1 to about 8 g/l; most preferably about 1 to about 5 g/l.

The preferred concentration of boric acid when it is used ranges from about 1 g/l to about the saturation point, more preferably about 5 to 15 grams per liter, most preferably about 8 to 12 grams per liter.

Preferably, the electrolytic current density employed in the process of the present invention ranges from about 30 to about 120 Amps/square decimeter, more preferably about 45 to about 80 A/dm$^2$, most preferably about 45 to 60 A/dm$^2$.

The preferred electrolysis time ranges from about 20 seconds to about 3 minutes, more preferably 20 seconds to about 90 seconds, most preferably 20 seconds to about 60 seconds.

The distance from the aluminum surface to the inert electrode, which may preferably be graphite, chromium or lead, is preferably up to about 1.5 centimeters, more preferably from about 1 to 1.5 cm.

Graining is preferably conducted with alternating current. When alternating current is used, a frequency in excess of 50 Hz produces the best graining effect. A frequency of 60 to about 300 Hz is most preferred.

After electrochemical graining, the sheet is anodized. This may be performed by passing the sheet through an anodizing bath containing, for example, sulfuric or phosphoric acid.

The preferred concentration of acid is from 10 to 20 weight %. The temperature of the anodizing bath is from 20° to 80° C. and best results are obtained if the temperature is from 20° to 40° C. Best results are also obtained if a direct current is impressed on the aluminum sheet in the anodizing bath and the current density is in the range of from 1 to 100 amperes per square foot. The preferred current density is from 10 to 50 amperes per square foot. The anodizing step can be completed in from ½ to 3 minutes but usually this step takes no longer than 1 to 2 minutes.

In the production of lithographic printing plates, it is advantageous to subsequently treat the grained or grained and anodized plate with a hydrophilizing interlayer composition prior to coating with the lithographic photosensitizer. These interlayer treatments serve to better adhere the coating to the surface and also render the aluminum surface more hydrophilic. Typical interlayer treatments comprise polyvinyl phosphonic acid, sodium silicate, the alkali zirconium fluorides, such as potassium zirconium hexafluoride, and hydrofluozirconic acid. These are disclosed in U.S. Pat. Nos. 3,160,506 and 2,946,683 to be for preparing aluminum bases to receive a light-sensitive coating.

Lithographically suitable photosensitive compositions typically comprise aromatic diazonium salts, quinone diazides and photpolymerizable compounds which are well known in the art. These are typically admixed with binding resins to extend the number of copies which a plate may reproduce. Examples of such binding resins include polyurethanes and phenol-formaldehyde resins, among a wide variety of others which are well known in the art.

The invention is further illustrated by the following examples:

EXAMPLE 1

A section of 1100 aluminum alloy is degreased in a conventional aqueous alkaline degreasing solution and electrolytically grained using 900 coulombs of AC electricity in an aqueous solution containing 13 g/l $HNO_3$ and 65 g/l $Al(NO_3)_3$. Upon rinsing, the surface is anodized using 240 coulombs of DC electricity wherein the aluminum is made the anode. The electrolyte is 150 g/l $H_2SO_4$. The anodized surface is rinsed and subsequently hydrophilized by treating with a 2.2 g/l solution of polyvinyl phosphonic acid maintained at 65.5° C. for 30 seconds. The plate is rinsed, dried, and coated with a negative working solution comprising a polyvinyl formal-acetate-alcohol terpolymer, phosphoric acid, a phthalocyanine pigment and a diazonium condensation product of 3-methoxy-4-diazo diphenyl amine sulfate and 4,4'bis methoxymethyl diphenyl ether isolated as the mesitylene sulfonate salt. A coating weight of 700 $mg/M^2$ is used.

Upon drying, the coated plate is exposed and developed to yield a solid seven on a 21-step Stouffer Step Wedge. The developed and finished plate is run under normal press conditions on a sheet-fed press using a Dahlgren fountain solution and a medium tack ink. A relative test for ink-water balance is to turn down the water setting until the plate begins to scum and to turn up the setting until the plate floods. In the first instance, insufficient water is carried to permit the plate to run clean. This results in ink being transferred to the non-image area of the printed copy. In the latter instance, excessive water is accumulated in the ink system which causes undesireable ink emulsification and roll stripping. The ink-water balance scale ranges from 0–100 and, although a relative scale which varies from printing press to printing press, is a consistent balance indication on any single machine. In the instant test a low of 36 and high of 40 is found.

The plate prepared above is run until image breakdown. 150,000 quality impressions are made before the image fails. A section of the plate prepared as described is evaluated using Scanning Electron Microscopy (SEM) and a Perthometer for surface roughness. At magnifications of 240×, 1200× and 6000× the surface is observed to be composed of uniform holes ranging between 2μ and 6μ in diameter. The surface is further observed to be essentially planar since there is no substantial variation in grain peak height. The average depth of grain is 4.5μ.

EXAMPLE 2

In like manner, a plate is treated, coated and tested as described in Example 1, except that 8 g/l HCl and 40 g/l $AlCl_3$ are used in lieu of $HNO_3/Al(NO_3)_3$ to electrochemically grain the aluminum. Under press conditions, the plate is observed to print acceptably between the fountain settings of 36 and 42. 180,000 acceptable copies are made before image failure occurs.

Using SEM the surface is observed to have fewer discrete pores than with $HNO_3$. The surface is composed of uniform holes ranging between 4μ and 9μ in diameter. The surface is further observed to be essentially planar in that there is no substantial variation in grain peak height. The average depth of grain is 5.25μ.

EXAMPLE 3

A section of 1100 aluminum alloy is degreased in a conventional aqueous alkaline degreasing solution and rinsed. The plate is then immersed in a solution containing 100 g/l $HNO_3$ (100%) and 100 g/l $NH_4F$ for 60 seconds at 60° C. The treated plate is well rinsed and dried. Upon SEM evaluation at magnifications of 240×, 1200× and 6000×, the surface is observed to be highly textured. It is characterized by uniformly distributed nodules being about 10μ in diameter, 8–10μ in height and about 40–50μ from peak-to-peak. It further appears that the action of the etching solution upon the aluminum begins at the intermetallic boundries and results in a substantially non-directional topography.

A section of aluminum prepared as described above is anodized and hydrophilized as described in Example 1 and likewise coated. The exposed and developed plate is run on a press to determine ink/water balance latitude. A range from 28 to 52 is found. A run length determination is made where it is found that fewer than 50,000 acceptable copies are printed before plate breakdown. This is attributable to the non-porous structure of the surface.

EXAMPLE 4

A section of 1100 aluminum alloy is prepared in like manner as described in Example 3 except that 900 coulombs of AC electricity are employed to enhance the etching with $HNO_3$ and $NH_4F$. The thusly prepared plate is well rinsed and dried. Upon SEM elvaluation at magnifications of 240×, 1200× and 6000×, the surface is similarly observed to be highly textured. It is characterized by uniformly distributed nodules being about 10μ in diameter, 6–8μ in height and 35–45μ from peak-to-peak. The topography is described as being uniform and substantially non-directional and is further described as having a very fine porous structure uniformly covering the entire surface.

A section of aluminum prepared as described above is anodized and hydrophilized as detailed in Example 1, and likewise coated. The exposed and developed plate is run on a press to determine the ink water balance latitude. A range from 28 to 56 is found. A run length determination is made where it is found that about 80,000 acceptable copies are printed before plate breakdown.

EXAMPLE 5

A section of 1100 aluminum alloy etched with $HNO_3$ and $NH_4F$ as described in Example 3 was additionally treated by electrochemically graining, anodizing and hydrophilizing as detailed in Example 1. The treated, rinsed and dried plate is likewise coated, exposed, developed and run on a sheet fed press until image breakdown. 220,000 quality impressions are made before the image fails. The ink water balance latitude is found to be between 28 and 56.

A section of the plate described above is evaluated using SEM at magnifications of 240×, 1200× and 6000×. The surface is observed to be composed of uniform holes ranging between 2μ and 4μ in diameter. The surface is also observed to be non-planar but rather three dimensional. The average depth of grain is 6.2μ.

EXAMPLE 6–12

Examples 6–12 show the effects of different echant combinations when followed by electrochemical graining. In all examples, sections of 1100 aluminum alloy are degreased, anodized and hydrophilized as described in Example 1. When $HNO_3/Al(NO_3)_3$ is the graining electrolyte, the parameters are those given in Example 1.

When $HCl/AlCl_3$ is the graining electrolyte, the parameters are those given in Example 2.

Examples 6–12

| Example | Etchant | Electrochemical Graining Electrolyte | Ink/Water Range | Run Length | Gram Depth | Topography |
|---|---|---|---|---|---|---|
| 6 | 100 g/l $HNO_3$ (100%) + 100 g/l $NH_4F$ | 8 g/l HCL + 40 g/l $AlCl_3$ | 28 to 56 | 250,000 | 6.5μ | three dimensional 6–10μ pores |
| 7 | 100 g/l $HNO_3$ (100%) + 100 g/l $NH_4HF_2$ | 13 g/l $HNO_3$ 65 g/l $Al(NO_3)_3$ | 30 to 56 | 205,000 | 5.7μ | three dimensional 2–6μ pores |
| 8 | 100 g/l $HNO_3$ (100%) | 13 g/l $HNO_3$ + 65 g/l $Al(NO_3)_3$ | 36 to 42 | 150,000 | 4.5μ | planar surface 2.6μ pores |
| 9 | 50 g/l $NH_4F$ | 13 g/l $HNO_3$ + 65 g/l $Al(NO_3)_3$ | 32 to 46 | 160,000 | 4.7μ | essentially planar 2.6μ pores |
| 10 | 50 g/l $NH_4HF_2$ | 13 g/l $HNO_3$ + 65 g/l $Al(NO_3)_3$ | 32 to 44 | 160,000 | 4.8μ | essentially planar 4.6μ pores |
| 11 | 50 g/l $NH_4F$ + 50 g/l $NH_4HF_2$ + 50 g/l $HNO_3$ | 13 g/l $HNO_3$ + 65 g/l $Al(NO_3)_3$ | 28 to 54 | 210,000 | 6.1μ | three dimensional 4.7μ pores |
| 12 | 100 g/l $NH_4F$ + 100 g/l HCL (37%) | 8 g/l HCL + 40 g/l $AlCl_3$ | 26 to 58 | 265,000 | 6.4μ | three dimensional 6.9μ pores |

Example 1 is a standard art recognized method of preparing an electrochemically grained aluminum carrier material using $HNO_3/Al(NO_3)_3$. This is a control example for comparison purposes.

Example 2 is a standard art recognized method of preparing an electrochemically grained aluminum carrier material using $HCl/AlCl_3$. This is also a control for comparison purposes.

Examples 3 and 4 show the advantage of etching prior to electrochemical graining. Here the surface, unlike Examples 1 and 2, is made three dimensional by expanding grain depth. The significant effect is to give increased latitude on ink/water balance. The press data show that this method is not a substitute for electrochemical graining since the run length is adversely affected.

Example 5 shows the advantage offered by etching first to give an expanded three dimensional surface followed by electrochemical graining to give a highly porous surface. In this instance improved ink/water balance and press performance is realized.

Examples 6, 7, 11 and 12 show the utility of using an acid with a fluoride containing compound as an etchant followed by electrochemical graining to improve the ink/water balance and run length.

Example 8, 9 and 10 show that an acid used without a fluorine containing compound, or a fluorine containing compound without an acid is insufficient to afford significant improvement over the control.

What is claimed is:

1. A method for treating an aluminum sheet which comprises:

(a) immersing said sheet in an aqueous bath containing
  (i) up to about 25% by weight of hydrochloric and/or nitric acids, and
  (ii) from about 1 to about 25% by weight of an inorganic fluorine containing acid or a salt thereof; said immersion being conducted for a length of time sufficient to impart an etch to the surface of said aluminum sheet; and (b) electrochemically graining said sheet in an aqueous electrolyte comprising one or more acids selected from the group consisting of nitric acid and hydrochloric acid; and (c) anodizing said sheet in an aqueous electrolyte comprising one or more acids selected from the group consisting of sulfuric acid and phosphoric acid.

2. The method of claim 1 wherein said ingredient (ii) is selected from the group consisting of HF, $HSiF_6$, $HPF_6$, $HBF_4$, $K_2ZrF_6$, $K_2TiF_6$, $NH_4F$ or $NH_4HF_2$.

3. The method of claim 1 wherein said electrolyte (b) further comprises one or more compounds selected from the group consisting of oxalic acid, aluminum nitrate, aluminum chloride, hydrogen peroxide and boric acid.

4. The method of claim 1 wherein said bath (a) further comprises one or more compounds selected from the group consisting of an ammonium, potassium, sodium or lithium persulfate, peroxydisulfate or disulfate, or a sulfonic acid.

5. The method of claim 1 wherein said ingredient (i) is present in an amount of from about 5% to about 25%.

6. The method of claim 1 wherein said step (a) is conducted for at least 5 seconds.

7. The method of claim 1 wherein said bath (a) is maintained at a temperature of from about 10° C. to about 95° C.

8. The method of claim 1 wherein said aluminum sheet is electrolyzed in said bath (a) using alternating or direct current at about 30–45 Amps/$dm^2$.

9. The method of claim 1 wherein said electrolyte comprises nitric acid in a concentration of from about 3 g/l to about 500 g/l.

10. The method of claim 1 wherein said electrolyte comprises hydrochloric acid in a concentration of from about 3 g/l to about 100 g/l.

11. The method of claim 1 wherein the electrochemical graining step (b) is conducted with a current density of from about 30 to about 120 Amps/$dm^2$.

12. The method of claim 1 wherein the anodizing step (c) employs an electrolyte having a temperature of from about 20° C. to about 80° C. and an acid concentration of from about 10% to about 20% by weight.

13. The method of claim 1 further comprising the step of applying a hydrophilizing interlayer composition to said sheet after anodizing.

14. The method of claim 13 wherein said interlayer composition is selected from the group consisting of polyvinyl phosphonic acid, sodium silicate and hydrofluozirconic acid and alkali zirconium fluorides.

15. The method of claim 1 further comprising the step of applying a lithographically suitable photosensitive composition to said treated aluminum sheet.

16. The method of claim 13 further comprising the step of applying a lithographically suitable photosensitive composition to said treated aluminum sheet.

17. The method of claim 15 wherein said photosensitive composition comprises an aromatic diazonium salt, quinone diazide or photopolymerizable compound.

18. The treated aluminum sheet produced according to the method of claim 1.

19. The treated aluminum sheet produced according to the method of claim 15.

20. The treated aluminum sheet produced according to the method of claim 16.

21. The treated aluminum sheet produced according to the method of claim 17.

* * * * *